US010940496B2

(12) United States Patent
Silva, Jr. et al.

(10) Patent No.: US 10,940,496 B2
(45) Date of Patent: Mar. 9, 2021

(54) SYSTEMS AND METHODS OF STORAGE FIRE PROTECTION

(71) Applicant: Tyco Fire Products LP, Lansdale, PA (US)

(72) Inventors: Manuel R. Silva, Jr., Cranston, RI (US); Andrea L. Palmer, West Warwick, RI (US); Krista N. Brouwer, Plainville, MA (US); Lauren A. Richard, Plymouth, MA (US)

(73) Assignee: Tyco Fire Products LP, Lansdale, PA (US)

( * ) Notice: Subject to any disclaimer, the term of this patent is extended or adjusted under 35 U.S.C. 154(b) by 151 days.

(21) Appl. No.: 16/221,074

(22) Filed: Dec. 14, 2018

(65) Prior Publication Data

US 2019/0184411 A1 Jun. 20, 2019

Related U.S. Application Data

(60) Provisional application No. 62/599,180, filed on Dec. 15, 2017.

(51) Int. Cl.

| | |
|---|---|
| ***B05B 1/26*** | (2006.01) |
| ***A62C 35/68*** | (2006.01) |
| ***A62C 31/02*** | (2006.01) |
| ***A62C 37/14*** | (2006.01) |

(52) U.S. Cl.

CPC ..... *B05B 1/267* (2013.01); *A62C 31/02* (2013.01); *A62C 35/68* (2013.01); *A62C 37/14* (2013.01)

(58) Field of Classification Search

CPC ..... B05B 1/265; B05B 1/262; B05B 1/26; A62C 3/002

USPC ..... 169/37

See application file for complete search history.

(56) References Cited

U.S. PATENT DOCUMENTS

| | | | | |
|---|---|---|---|---|
| 2,165,477 | A * | 7/1939 | Griffith | B05B 1/265 169/39 |
| 4,136,740 | A | 1/1979 | Groos et al. | |
| 5,579,846 | A | 12/1996 | Meyer et al. | |
| 5,609,211 | A | 3/1997 | Meyer et al. | |
| 5,862,994 | A * | 1/1999 | Pounder | A62C 31/02 169/37 |
| 6,585,054 | B1 | 7/2003 | Thomas et al. | |
| 6,976,543 | B1 | 12/2005 | Fischer | |
| 7,624,812 | B2 | 12/2009 | Pahila | |

(Continued)

FOREIGN PATENT DOCUMENTS

WO WO-2015/191619 A1 12/2015

*Primary Examiner* — Jason J Boeckmann
(74) *Attorney, Agent, or Firm* — Foley & Lardner LLP

(57) ABSTRACT

A fire protection sprinkler includes a sprinkler frame and a deflector. The deflector is coupled to the sprinkler frame and distributes fluid discharged from an outlet of the sprinkler in a spray pattern centered about a sprinkler axis and defined by a fluid density in a first quadrant area 2.5 feet (ft.) below the sprinkler and perpendicular to the sprinkler axis, the first quadrant area having a first corner disposed along the sprinkler axis with a first edge extending in the direction of a fluid supply pipe, a second edge extending perpendicular to the first edge and intersecting the first edge at the sprinkler axis, the first quadrant area being defined by a grid of one square foot areas totaling an area of no more than 10 ft.×10 ft., the total fluid density being at least 15 gpm/sq. ft.

18 Claims, 7 Drawing Sheets

(56) References Cited

U.S. PATENT DOCUMENTS

| | | | |
|---|---|---|---|
| 7,766,091 | B2 | 8/2010 | Fischer |
| 9,223,266 | B2 | 12/2015 | Hara |
| 2011/0036598 | A1 | 2/2011 | Pahila |
| 2015/0027739 | A1 | 1/2015 | Multer et al. |
| 2017/0113078 | A1 | 4/2017 | Magnone et al. |

* cited by examiner

SYSTEMS AND METHODS OF STORAGE FIRE PROTECTION

CROSS-REFERENCE TO RELATED APPLICATIONS

The present disclosure claims the benefit of and priority to U.S. Provisional Application No. 62/599,180, filed Dec. 15, 2017, titled "DEVICE AND MEANS FOR FIRE STORAGE PROTECTION," the disclosure of which is incorporated herein by reference in its entirety.

BACKGROUND

Fire protection systems for storage occupancies can be used to protect stored commodities. Fire protection systems can include automatic sprinklers.

SUMMARY

At least one aspect is directed to a fire protection sprinkler having a spray pattern for storage protection. The sprinkler includes a sprinkler frame and a deflector. The sprinkler frame has a body for coupling to a fluid supply pipe defining an inlet for the receipt of fluid, and an outlet with an internal passageway axially extending between the inlet and the outlet along a sprinkler axis disposed perpendicular to the fluid supply pipe. The deflector is coupled to the sprinkler frame. The deflector distributes fluid discharged from the outlet in a spray pattern below the sprinkler, the spray pattern being centered about the sprinkler axis and defined by a fluid density in a first quadrant area 2.5 feet (ft.) below the sprinkler and perpendicular to the sprinkler axis, the first quadrant area having a first corner disposed along the sprinkler axis with a first edge extending in the direction of the fluid supply pipe, a second edge extending perpendicular to the first edge and intersecting the first edge at the sprinkler axis, the first quadrant area being defined by a grid of one square foot areas totaling an area of no more than 10 ft.×10 ft., the total fluid density being at least 15 gpm/sq. ft., the first quadrant area including a first zone of fluid distribution spaced four feet from the first edge and within six feet of the first edge, the first zone being spaced two feet from the second edge and within the six feet of the second edge, the fluid density in the first zone being at least 3% of the total fluid density.

At least one aspect is directed to a deflector of a sprinkler. The deflector includes a deflecting surface coupled to a mount of the sprinkler. The deflecting surface distributes fluid discharged from an outlet of the sprinkler in a spray pattern below the sprinkler, the spray pattern being centered about a sprinkler axis of the sprinkler and defined by a fluid density in a first quadrant area 2.5 feet (ft.) below the sprinkler and perpendicular to the sprinkler axis, the first quadrant area having a first corner disposed along the sprinkler axis with a first edge extending in the direction of a fluid supply pipe, a second edge extending perpendicular to the first edge and intersecting the first edge at the sprinkler axis, the first quadrant area being defined by a grid of one square foot areas totaling an area of no more than 10 ft.×10 ft., the total fluid density being at least 15 gpm/sq. ft., the first quadrant area including a first zone of fluid distribution spaced four feet from the first edge and within six feet of the first edge, the first zone being spaced two feet from the second edge and within the six feet of the second edge, the fluid density in the first zone being at least 3% of the total fluid density.

At least one aspect is directed to an upright sprinkler that generates an innovative spray pattern having a fluid distribution that is between known standard spray and extended spray. The sprinkler, when incorporated into a system, provides for overlap of the innovative spray pattern that is effective in rack storage fire protection with a lowered total fluid demand. The sprinkler can be fire tested and shown to be effective in a worst-case-scenario that includes low clearance between the commodity and the ceiling, Group A plastics, blocked flues and obstructions in the aisles. The sprinkler can be effective in the protection of less hazardous commodities or less challenging storage arrangements.

At least one aspect is directed to an upright fire protection sprinkler that includes a sprinkler frame having a body defining an inlet, and an outlet with an internal passageway axially extending between the inlet and the outlet along a sprinkler axis. The inlet defines a first diameter of the passageway and the outlet defines a second diameter of the passageway. The sprinkler frame includes a mount spaced axially from the outlet. A deflector is disposed about the mount and centered along the sprinkler axis with an internal deflecting surface opposed to the outlet and circumscribed about the sprinkler axis. The internal deflecting surface has a central region, a peripheral region and an arcuate annulus region between the central region and the peripheral region. The central region is configured as a planar surface disposed perpendicular to the sprinkler axis. The central region is contiguous with the arcuate annulus to define a first diameter of the deflector. The arcuate annulus is also contiguous with the peripheral region to define a second diameter of the deflector. The peripheral region includes a plurality of spaced apart planar surfaces skewed outwardly with respect to the sprinkler axis to farm an outermost discontinuous peripheral edge of the deflector and define a third diameter of the deflector. The second diameter of the passageway can be greater than or equal to the first diameter of the deflector. A ratio of the second diameter of the deflector-to-the first diameter can range from 2:1 to 3.5:1, and where the arcuate annulus defines a depth, a ratio of the second diameter of the deflector-to the depth of the arcuate annulus can range from 8:1 to 10:1.

At least one aspect is directed to a fire protection sprinkler having a spray pattern for storage protection. The sprinkler includes a sprinkler frame having a body for coupling to a fluid supply pipe defining an inlet for the receipt of fluid, an outlet with an internal passageway axially extending between the inlet and the outlet along a sprinkler axis disposed perpendicular to the fluid supply pipe. The sprinkler a deflector coupled to the sprinkler frame for distributing fluid discharged from the outlet in a spray pattern below the sprinkler. The spray pattern is centered about the sprinkler axis and defined by a fluid density in a first quadrant area 2.5 feet below the sprinkler and perpendicular to the sprinkler axis. The first quadrant area has a first corner disposed along the sprinkler axis with a first edge extending in the direction of the fluid supply pipe and a second edge that extends perpendicular to the first edge and intersects the first edge at the sprinkler axis. The first quadrant area is defined by a grid of one square foot areas totaling an area of no more than 10 ft.×10 ft. The total fluid density is at least 15 gpm/sq. ft. in which the first quadrant area includes a first zone of fluid distribution spaced four feet front the first edge and within six feet of the first edge, that is spaced two feet from the second edge and within the six feet of the second edge with the fluid density in the first zone being at least 3% of the total fluid density.

At least one aspect is directed to a method of providing and qualifying a sprinkler for low clearance fire protection. The method includes locating the sprinkler in an upright orientation above a floor. The sprinkler has a body and a deflector coaxially aligned along a sprinkler axis and generating a spray pattern from the sprinkler in which the spray pattern can include a first fluid distribution 2.5 ft. below the deflector having a total fluid density of at least 15 gpm/sq. ft. in a first gridded area of one square foot areas totaling an area of no more than 10 ft×10 ft. The total area has a first edge and a second edge perpendicular to the first edge with the intersection of the first and second edges being disposed along the sprinkler axis. At least 3% of the total fluid density is provided in a first zone of the first gridded area that is spaced four feet from the first edge and within six feet of the first edge, spaced two feet from the second edge and within the six feet of the second edge. The method includes generating a second fluid distribution 12.5 ft. below the deflector having a total fluid density of at least 12 gpm/sq. ft. in a second gridded area of one square foot areas totaling an area of no more than 10 ft.×10 ft., with a first edge and a second edge perpendicular to the first edge and the intersection of the first and second edges being disposed along the sprinkler axis. At least 35% of the total fluid density in a first zone of the second gridded area is within seven feet of the first edge and within the seven feet of the second edge.

At least one aspect is directed to a system of low clearance coverage fire protection of a storage occupancy. The occupancy is defined by a floor and a ceiling above the floor with a storage arrangement between the ceiling and floor. The system includes a plurality of parallel fluid supply pipes disposed beneath the ceiling and a plurality of fluid distribution devices coupled to the fluid supply pipes to define four fluid distribution devices in a rectangular arrangement above the floor. The stored commodity defines a clearance, with the ceiling of no more than five feet (5 ft.). Each of the fluid distribution devices generates a spray pattern that overlaps one another to define a rectangular area of fluid distribution 2.5 ft. below the fluid distribution devices. The rectangular area has a first pair of edges extending parallel to the fluid supply pipes and a second pair of edge extending perpendicular to the first pair of edges. The four fluid distribution devices are axially aligned above a corner of the rectangular area. The fluid distribution area is defined by a grid of one square foot areas totaling an area of no more than 12 ft.×8 ft. The rectangular area of fluid. distribution has a total fluid density of at least 60 gpm/sq. ft. with the rectangular area including a first zone of fluid distribution of a 4 ft.×4 ft. area centered in the rectangular area. The first zone has a fluid density that is at least 3% of the total fluid density.

At least one aspect is directed to a system of low clearance coverage fire protection of rack storage that includes a plurality of upright sprinklers for installation at a sprinkler-to-sprinkler spacing of 12 ft.×8 ft. above the rack storage that defines a clearance of no more than 5 ft. The plurality of sprinklers includes a number of design sprinklers ranging from 6-12 sprinklers at the sprinkler-to-sprinkler spacing to define a distribution density of 055 gpm/sq. ft. and a total flow ranging from 300-1200 gpm at a minimum operating pressure ranging from 7 psi to 25 psi.

At least one aspect is directed to a method of low clearance coverage fire protection of rack storage with a clearance of no more than 5 ft. The method includes obtaining a plurality of upright fire protection sprinklers. Each sprinkler has a sprinkler frame having a body defining an inlet, an outlet with an internal passageway axially extending between the inlet and the outlet along a sprinkler axis. The sprinkler frame includes a mount spaced axially spaced from the outlet, a deflector disposed about the mount and centered along the central axis with an internal deflecting surface opposed to the outlet and circumscribed about the sprinkler axis. The internal deflecting surface has a central region, a peripheral region and an arcuate annulus region between the central region and the peripheral region. The central region is a planar surface disposed perpendicular to the sprinkler axis, and the peripheral region has a plurality of spaced apart planar surfaces each angled outwardly with respect to the sprinkler axis to define a maximum diameter of the deflector circumscribed about the sprinkler axis. The method includes providing the plurality of upright fire protection sprinklers for coupling to a network of fluid supply pipes in a spaced apart arrangement having a sprinkler spacing of no more than 12 ft.×12 ft with a minimum operating pressure ranging from 7 psi. to 25 psi. The plurality of sprinklers can include six design sprinklers to define a distribution density of 0.55 gpm/sq. ft. at the minimum operating pressure.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification.

BRIEF DESCRIPTION OF THE DRAWINGS

The accompanying drawings are not intended to be drawn to scale. Like reference numbers and designations in the various drawings indicate like elements. For purposes of clarity, not every component can be labeled in every drawing. In the drawings.

DETAILED DESCRIPTION

Figure 1:
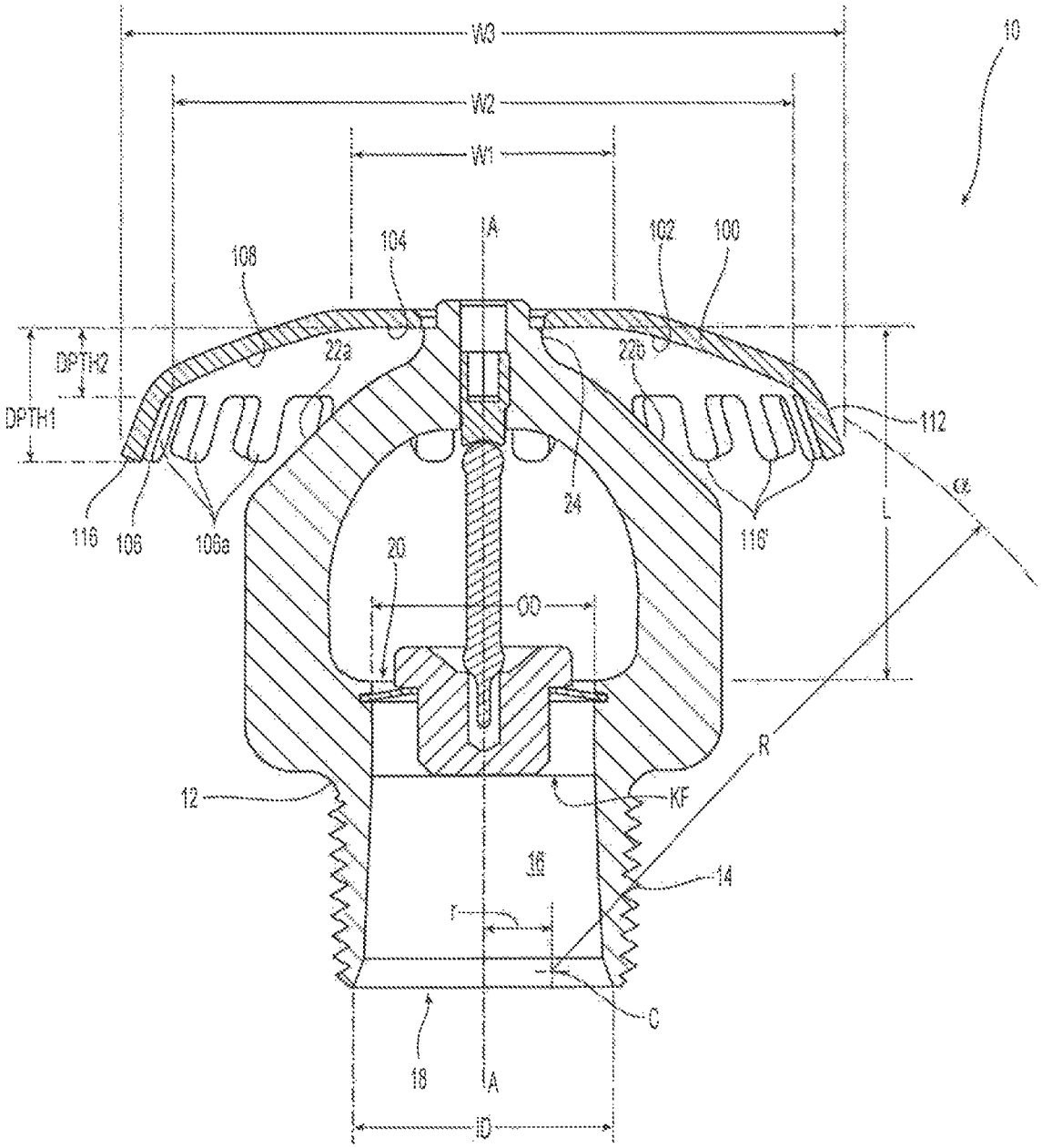
FIG. 1 is a cross-sectional view of an example upright sprinkler fluid distribution device.

The present disclosure relates generally to fire protection systems and the method of their design and installation. More particularly, the present disclosure provides a fire protection sprinkler system, suitable for the protection of storage occupancies and in particular storage occupancies using rack storage. An automatic sprinkler can include a fire suppression or control device that operates automatically when its heat-activated element is heated to its thermal rating or above, allowing water to discharge over a specified area.

Installation standards can provide for design criteria based upon particular storage conditions and the type of fire protection sprinkler being employed. In particular, the NFPA 13 specifies hydraulic design criteria or approaches for fire protection systems to standardize that a particular storage condition is addressed with a particular level of firefighting fluid density as measured in gallons per minute per square foot (gpm/sq. ft.). Fire protection systems are hydraulically designed to satisfy the design criteria. As used herein, a "hydraulically designed system," is a calculated system in which pipe sizes are selected on a pressure loss basis to provide a prescribed water density, in gallons per minute per square foot, distributed with a reasonable degree of uniformity over a specified area. In addition to the particular density, the standards specify the area, e.g., the "hydraulic design area," over which the density requirement is to be satisfied. A "hydraulic design area" is an area defined in square units of measure, comprising a defined number of hydraulically remote sprinklers at a defined spacing between each sprinkler. "Hydraulically remote sprinklers" are sprinklers that place the greatest water demand on a system in order to provide a prescribed minimum discharge pressure or flow. The hydraulically remote sprinklers may or may not be physically located the furthest from the fluid the water supply providing the prescribed minimum pressure or flow.

For sprinklers installed above the stored commodity or at the ceiling of the storage occupancy, the hydraulic design criteria specified by the installation standards may specify the "design area" in square feet over which a prescribed density (in gpm) is to be provided. The design criteria can provide a number of "design sprinklers," at a particular spacing or for a minimum or maximum coverage area, for which a minimum design pressure or flow is specified. Under this approach, the number of "design sprinklers" is to be derived from successful results of worst-case full-scale fire testing using the subject sprinkler at a particular sprinkler-to-sprinkler spacing with the number increased by 50%. However, regardless of the fire test results, the special design approaches of NFPA 13 still include minimum design requirements. For example, the standards require that the number of design sprinklers be no less than: (i) twelve sprinklers for standard coverage sprinklers ("twelve head design"); (ii) eight sprinklers for extended coverage sprinklers on 12 ft.×12 ft sprinkler-to-sprinkle spacing; or (iii) six sprinklers for extended coverage sprinklers based on 14 ft i4 ft, sprinkler-to-sprinkler spacing. Moreover, NFPA 13 provides that the minimum operating area based on the sprinkler-to-sprinkler spacing of the. given number of design sprinklers shall be no less than 768 square feet. Other industry accepted standards, for example standards under FM Global (FM), define the number of design sprinklers for use in sprinkler systems for a storage occupancy based upon. sprinkler orifice size, orientation, RTI (thermal response), spacing, and minimum operating pressure.

In the case of rack storage, the density and design area specified under the standards are dependent upon storage conditions, which can include: the hazard classification of the commodity being stored, the arrangement of the stored commodity, the height of the storage, and the clearance between the ceiling of the storage occupancy and the top of the stored commodity. The number of design sprinklers is a function of the number of sprinklers which effectively addressed a fire under the particular storage condition of the worst-case-scenario fire testing. Regardless of the design approach, the design density requirement and area or design sprinklers together define a hydraulic demand (measured in gpm) that the "ceiling" sprinklers place on a system. In addition, the standards may specify a hose stream requirement, an additional amount of flow (gpm) required by the system for firefighting efforts. Additionally, the standards may require for certain installations, a number of sprinklers installed in the storage racks, e.g., "in-rack sprinklers." The installation standards can define an overall water flow rate or demand requirement for system.

The hydraulic designs and demand of the system define the water supply requirements of the system and the economic burden to fulfill those requirements, such as for example, by supplying the appropriate number and size of pump, piping or other fluid distribution equipment to meet the hydraulic designs. There can be a desired balance between fulfilling a level of hydraulic demand and the economic burden to supply that demand in order to provide a desired level of fire protection. It can be useful to minimize the hydraulic design area and/or number of design sprinklers of a system in order to reduce the overall hydraulic demand of the system in order to strike the appropriate balance. It can be useful to minimize the amount of fluid discharge from each sprinkler by minimizing the design flow or operating pressure of the sprinklers.

One type of rack storage configuration of particular interest is multi-row rack storage that includes Group A plastics in which the clearance between the top of the stored commodity and the ceiling is less than five feet (<5 ft.), "low clearance." This is considered to be a particular hazardous arrangement that requires a high water demand from the sprinklers, e.g., over 800 gallons per minute (gpm) using known storage sprinklers under the installation standards. Under NFPA 13, plastics, elastomers and rubber are classified as Group A, Group B, or Group C, with Group A indicating the highest combustibility of the three groups. The high sprinkler demand may be due to the close sprinkler-to-sprinkler spacing required by these known sprinklers and/or the limits of the spray pattern performance of these known sprinklers. Additionally, given the performance of theses known sprinklers, in-rack sprinklers may be required which would add to the hydraulic, demand of a system using these known sprinklers. Moreover, given the performance of these known sprinklers, such systems operational restrictions would likely be placed on such systems, for example, storage would not be permitted in the aisles between the racks. This would be disadvantageous to the owner or operator of the storage occupancy. Thus, known fire protection systems that employ automatic sprinklers to protect storage occupancies have hydraulic, installation and/or operational limitations that can add to the overall economic burden to provide the desired level of storage fire protection. The present solution can enable systems and methods that can reduce the hydraulic demand of a system and/or provide installation flexibility to provide fire protection for storage occupancies.

The types of sprinklers used in storage fire protection can include: pendent sprinklers, upright sprinklers, standard spray sprinklers, extended coverage (EC) sprinklers, control mode specific application (CMSA) sprinklers, early suppression fast response (ESFR) sprinklers, and control mode density area (CMDA) sprinklers.

FIG. 1 depicts a fluid distribution device 10. The fluid distribution device 10 can be a fire protection sprinkler that can provide an innovative fluid distribution or spray pattern of firefighting fluid that is suitable for fire protection of storage occupancies and in particular, those with rack storage arrangements. The innovative spray patterns and fluid distribution devices described herein can effectively provide rack-storage fire protection of plastics and rubber commodities including Group A plastics and lower classifications with a hydraulic demand lower than previously known without the need for in-rack sprinklers. Rack storage arrangements for protection include single row, double row and multi-row rack arrangements and arrangements with commodities stored in the aisles. Generally, the spray pattern provides for a radial outward throw in the region in close proximity just below the device 10, e.g., within three feet below the device, which is believed to be sufficient for protecting commodities in a low clearance arrangement, e.g., to a height with less than five feet of clearance to the ceiling. The spray pattern provides sufficient fluid distribution in close radial proximity to the device 10, e.g., within four feet of the device, to provide sufficient penetration to address a fire.

The fluid distribution device can include an upright-type fire protection sprinkler 10. The upright-type fire protection sprinkler 10 includes a frame 12 having a body 14 for coupling to a fluid supply pipe of firefighting fluid. The outside surface of the body 14 can include, for example, a thread for engagement with a correspondingly threaded pipe fitting or the outside surface can be tapered for a welded or soldered connection to the pipe fitting. The body 14 includes an internal passageway 16 that extends between an inlet 18 and an outlet 20 along a sprinkler axis A-A. The inlet 18 defines the inlet diameter D of the passageway and the outlet defines the outlet diameter OD of the passageway. The outlet diameter OD can be less than the inlet diameter ID and the passageway 16 can define the discharge characteristics of the sprinkler 10 including the pressure and/or flow characteristics of the sprinkler 10. Discharge characteristics of a sprinkler can be quantified by a nominal K-factor KF of a sprinkler, which is defined as an average flow of water in gallons per minute through the internal passageway divided by a square root of pressure of water fed into the inlet end of the internal passageway in pounds per square inch gauge $Q=K\sqrt{P}$ where P represents the pressure of water fed into the inlet end of the internal passageway-through the body of the sprinkler, in pounds per square inch gauge (psig); Q represents the flow of water from the outlet end of the internal passageway through the body of the sprinkler, in gallons per minute (gpm); and K represents the nominal K-factor constant in units of gallons per minute divided by the square root of pressure expressed in psig. The sprinkler 10 can have a nominal K-factor ranging from about 11 to about 36 $GPM/(PSI)^{1/2}$. The sprinkler 10 can have a nominal K-factor of 16.8 $GPM/(PSI)^{1/2}$. The body 12 can be of any nominal K-factor provided the sprinkler can deliver firefighting fluid for distribution in a spray pattern and/or performance as described herein. The sprinkler 10 can have a minimum operating pressure of less than 50 psi, such as from about 7 psi to about 25 psi, such as 10 psi. The sprinkler 10 can define a minimum working pressure of 10 psi for a working flow ranging from 50 gpm to 60 gpm.

The frame 12 can includes a pair of support arms 22*a*, 22*b* extending generally distally away from the outlet 20 to converge and form a mount 24 at the distal end of the frame 12. A deflector 100 can be supported by and fastened to the mount 24 so as to be axially spaced from the outlet 20 to distribute a flow of fire-fighting fluid, e.g., water, discharged from the outlet 20. The mount can be axially spaced at a length L from the outlet to locate that deflector 100 at an operative height from the outlet. One or more portions deflecting surfaces of the deflector 100 can be located at an operative distance height that is equivalent of the mount-to-outlet distance L. The distance L can be about 1.25 inches.

The sprinkler 10 can be an automatic sprinkler having discharge from the sprinkler body controlled by a seal assembly disposed in the outlet 20 supported in place by a thermally responsive trigger. The trigger assembly can be a bulb-type trigger assembly. The trigger assembly can include a thermally responsive solder element. The heat-responsive trigger assembly and its actuation can be defined by its nominal temperature rating and Response Time Index, or RTI. The trigger assembly can be thermally rated to a temperature at which the trigger assembly actuates to displace the closure or sealing assembly from the outlet 20 of the sprinkler body 12 to permit discharge from the sprinkler body. An example of a bulb-type trigger assembly for thermal operation of the sprinkler 10 is a "standard response" trigger thermally rated at 155° F. A group of sprinklers 10, each assembled with the trigger assembly, provided for a desired thermal response to a fire in a storage arrangement. Upon actuation, each sprinkler generated an innovative spray pattern. The collective thermal and fluid distribution response of the sprinklers 10 are effective for storage protection.

In characterizing the trigger assembly, the trigger can be defined by a range of industry accepted temperature ratings and classifications as listed; for example, in Table 6.2.5.1 of NFPA-13, which includes: (i) ordinary 135° F.-170° F.; (ii) intermediate 175° F.-225° F.; (iii) high 250° F.-300° F.; (iv) extra high 325° F.-375° F.; (v) very extra high 400° F.-475° F.; and (vi) ultra high 500° F.-575° F. The trigger assembly can have a nominal ordinary temperature rating 135° F.-170° F., such as a temperature rating of 155° F. The trigger assembly can have a nominal intermediate temperature rating 175° F.-225° F., such as a temperature rating of 200° F. The heat-responsive trigger assembly and its actuation can be defined by a Response Time Index, or RTI. As previously noted the trigger assembly RTI can be a "standard response" trigger and can range from at least 80 $meter^{1/2}sec^{1/2}$ ($m^{1/2}s^{1/2}$) to 160 ($m^{1/2}s^{1/2}$), such as from at least 135 ($m^{1/2}s^{1/2}$) to about 160 ($m^{1/2}s^{1/2}$), including 150 ($m^{1/2}s^{1/2}$) to about 160 ($m^{1/2}s^{1/2}$), such as 160 ($m^{1/2}s^{1/2}$). The RTI can be 90 ($m^{1/2}s^{1/2}$). The RTI can range to 50 ($m^{1/2}s^{1/2}$) or less so as to be a "quick" or "fast" response type sprinkler. Accordingly, the RTI of the trigger assembly can be of any response that is suitable for a given fire protection application. The sprinkler 10 can provide for a passive device that is thermally actuated. The sprinkler 10 can be configured as an active device in which operation of the sprinkler can be controlled by manual and/or an automated. actuator. For example, the seal assembly within the outlet 20 of the frame 12 can be supported by a frangible member that is fracture or displaced by an actuation assembly.

The deflector 100 can be disposed about the mount 24 and centered along the sprinkler axis A-A with an internal deflecting surface 102 opposed to the outlet 20 and circumscribed about the sprinkler axis A-A. The internal deflecting surface 102 can include a central region 104, a peripheral region 106 and an arcuate annulus region 108 between the central region 104 and the peripheral region 106. The central region 104 can be a planar surface disposed perpendicular to the sprinkler axis A-A and contiguous with the arcuate annulus 108 to define a first diameter WI of the deflector 100. The arcuate annulus 108 can be contiguous with the peripheral region 106 to define a second diameter W2 of the deflector that is larger than the first diameter WI. A ratio of the second diameter of the deflector-to-the first diameter (W2:W1) can range from 2:1 to 3.5:1, including from 2.3:1 to 3:1, including 2.3:1. to 2.5:1. The sprinkler components of the assembly 10 can be interrelated to provide the spray patterns described herein. The outlet diameter OD of the sprinkler body 12 can be greater than or equal to the first diameter W1 of the deflector 100, and a ratio of the outlet diameter-to-the first diameter of the deflector (OD:W1) can range from 1:1 to 2:1, including from 1:1 to 15:1, including from 1.1:1 to 1.3:1. The relationship between the frame and the deflector provides for the spray pattern and fire protection performance, as described herein, which can be incorporated into a system for storage fire protection with a lower fluid demand for the protection of comparable storage arrangements.

Figure 1B:
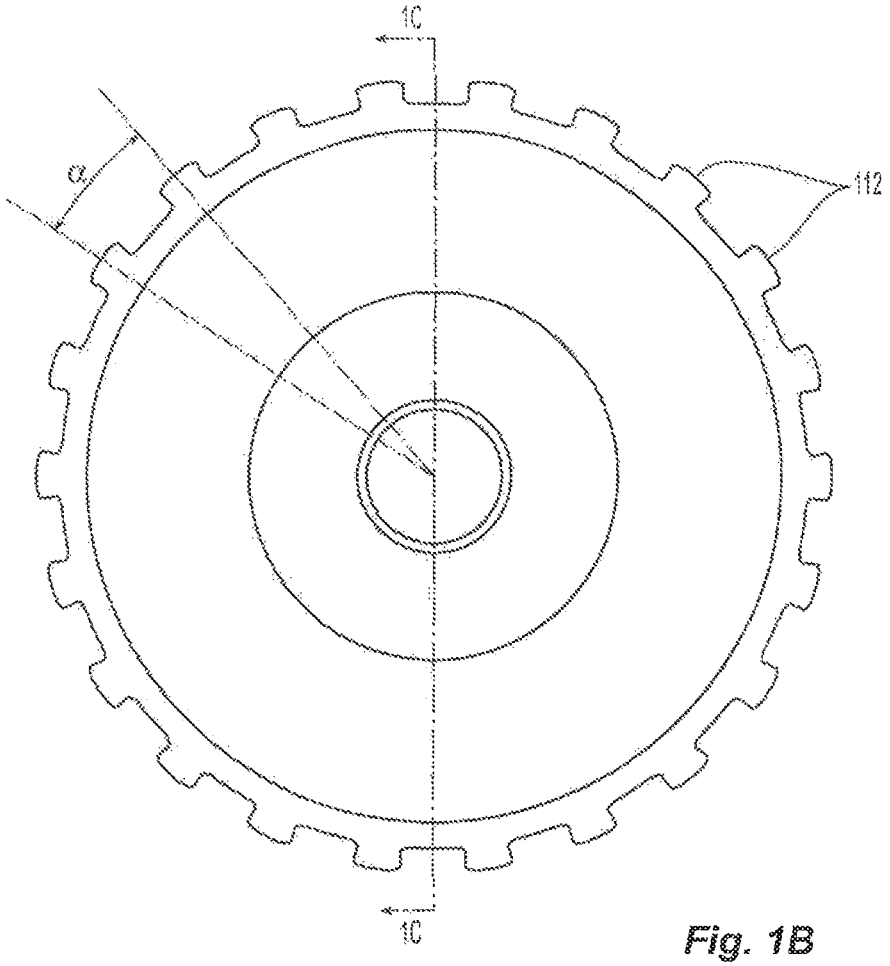
FIG. 1B is a plan view of an example deflector.
Figure 1C:
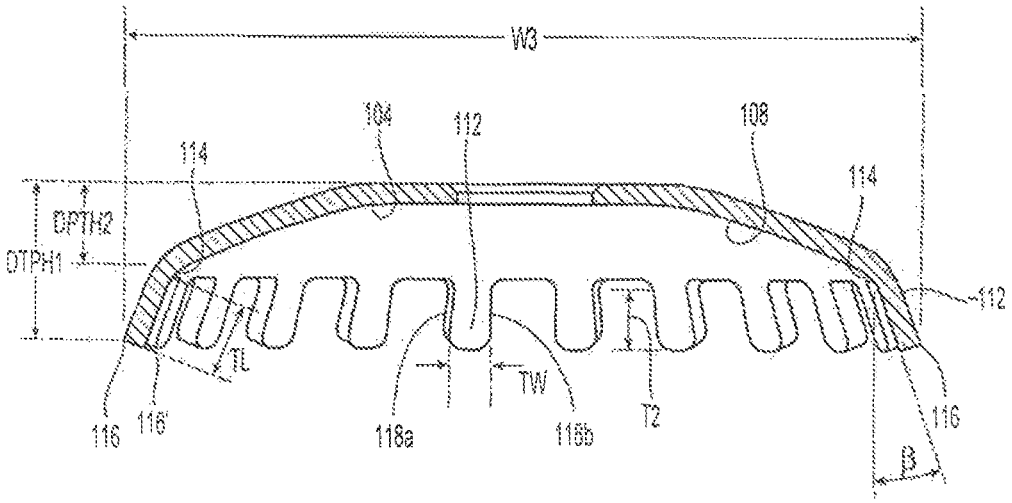
FIG. 1C is a cross-sectional view of an example deflector.

The peripheral region 106 of the internal deflecting surface 102 includes a group of spaced apart planar surfaces 106*a* which form the internal surface of the spaced apart tines 112 of the deflector 100. FIG. 1B depicts a plan view of the deflector 100, which has tines 112 that can be equiangularly spaced about the axis A-A. by an angle α. There can be twenty-two tines 112 spaced apart from one another by fifteen degrees. FIG. 1C depicts each tine 112 has a base 114 contiguous with the arcuate annulus portion 108 and a peripheral edge 116 radially spaced outward from the base 114 to define a tine length TL therebetween. Each tine 112 has a pair of lateral edges 118*a*, 118*b* spaced apart to define a tine width TW. The tine width TW can be constant over the tine length TL. The tine width TW can vary over the length provided the deflector 100 as a whole. The plurality of tines 118*a*, 118*b* can have a common tine width TW and a common tine length TL. The internal planar surfaces 106*a* of the tines 112 extending from the base 114 to the edge 116 between the edges 118*a*, 118*b* are skewed outwardly with respect to the sprinkler axis A-A to define a skew angle β. The spaced apart tines 112 and in particular their edges 116 collectively form an outermost discontinuous peripheral edge 116' of the deflector 100 to define a third diameter of the deflector W3. The tine width TW can range from 0.075-0.095 inch and the tine length ranges from 0.1-0.2.5 inches, including the tine width TW is 0.085 inch and the tine length TL is 0.2 inch and the third or widest portion of the deflector define the diameter W3 as being about 2 inches.

The central portion 104 of the deflector 100 and the peripheral edge 116' are axially spaced apart to define a first depth DPTH1 of the deflector 100 and the axial distance between the central portion 104 and the base 114 define the second depth DPTH2 of the deflector 100 and in particular the depth of the arcuate annulus portion 108. The diameters at the respective depths DPTH1, DPTH2 of the deflector 100 define a ratio (W3:W2) that can be about 1.1:1 to 1.3:1. To further characterize the depth of the deflector, the deflector 100 defines a ratio of the second diameter of the deflector-to the depth of the arcuate annulus (W2:DPTH2) as ranging from 8:1 to 10:1. The depth of the arcuate annulus DPTH2 can range from 0.15 inch to 0.25 inch and the second diameter W2 can range from 1.5 inch to 1.75 inch with the first diameter WI from 0.5 inch to 0.75 inch. The depth DPTH1 of the deflector can be about 0.35 inch and the second diameter W2 can be 1.65 inch with the first diameter W1 being 0.67 inch. The ratio of the second diameter-to-the overall depth of the deflector (W2:DPTH1) can range from 3:1 to 6:1. The depth of the deflector DPTH1 can range from 0.3 inch to 0.5 and the second diameter W2 of the deflector ranges from 1.5 inch to 1.75 inch. The depth of the deflector DPTH1 can be about 0.35 inch and the second diameter W2 can be 1.65 inch for a ratio of the second diameter-to-the overall depth of the deflector (W2:DPTH1) being about 4.7:1.

The arcuate annulus region 108 can be defined by a constant radius curvature R having a center of curvature C that, in the complete sprinkler assembly 10, is located axially between the inlet 18 and the outlet 20 of the body 12. The center of curvature C can be located off the sprinkler axis A-A and circumscribe the sprinkler axis at a radius r. The center of curvature C can be off-set from the axis A-A at a radius r ranging from of 0.03 to 0.05 inch with the radius of curvature R ranging from 1.5 inch to 1.75 inch. The deflector 100 has an outer surface which defines a profile that can parallel the internal fluid deflecting surface 102.

Features of the deflector 100, individually and collectively, alone or in combination with the sprinkler body 12 can enable generation of a spray pattern that is suited for low clearance rack storage fire protection. For example, a ratio of the second diameter OD of the sprinkler frame passageway 16 to the first diameter W1 of the deflector 100 (OD:W1) can range from 1:1 to 2:1, where the arcuate annulus region 108 of the deflector is defined by a constant radius curvature R having a center of curvature C disposed axially between the inlet 118 and the outlet 120 of the body and which circumscribes the sprinkler axis A-A at a radius r ranging from of 0.03 to 0.05 inch from the sprinkler axis A-A with the radius of curvature R ranging from 1.5 inch to 1.75 inch. Under a minimum fluid supply pressure of 10 psi, the present solution can enable a spray pattern with sufficient radial throw to wet within the low clearance region between the ceiling and the top of the stored commodity. The present solution can provide a sufficient penetration to a distance of at least twelve feet below the sprinkler to overcome the shadow of the fluid supply pipe and effectively address a fire in a lower region of the stored commodity. The deflector 100 can have dimensional relationships, such as for example, a ratio of the second diameter of the deflector-to-the first diameter (W2:W1) ranges from 2:1 to 3.5:1, the arcuate annulus defining a depth, a ratio of the second diameter of the deflector-to the depth of the arcuate annulus ranging from (W2:DPTH2) 8:1 to 10:1.

As an upright sprinkler, the sprinkler 10 can be installed atop a length of fluid supply pipe water. In an open state of the sprinkler 10, water at the inlet 18 of the sprinkler body 12 flows through the passageway 16 and is discharged from the outlet 20. The water discharged from the outlet 20 impacts the internal deflecting surface and forms an innovative spray pattern that is centered about the sprinkler axis to distribute the fluid below the sprinkler and the fluid supply pipe. In the case of storage protection, the sprinkler 10 and a fluid supply pipe can be installed above a stored commodity with a clearance between the ceiling and the top of the stored commodity, and the sprinkler assembly 10 and its deflector 100 can provide a fluid distribution device for protection of low clearance rack storage with lower water demand.

Figure 2:
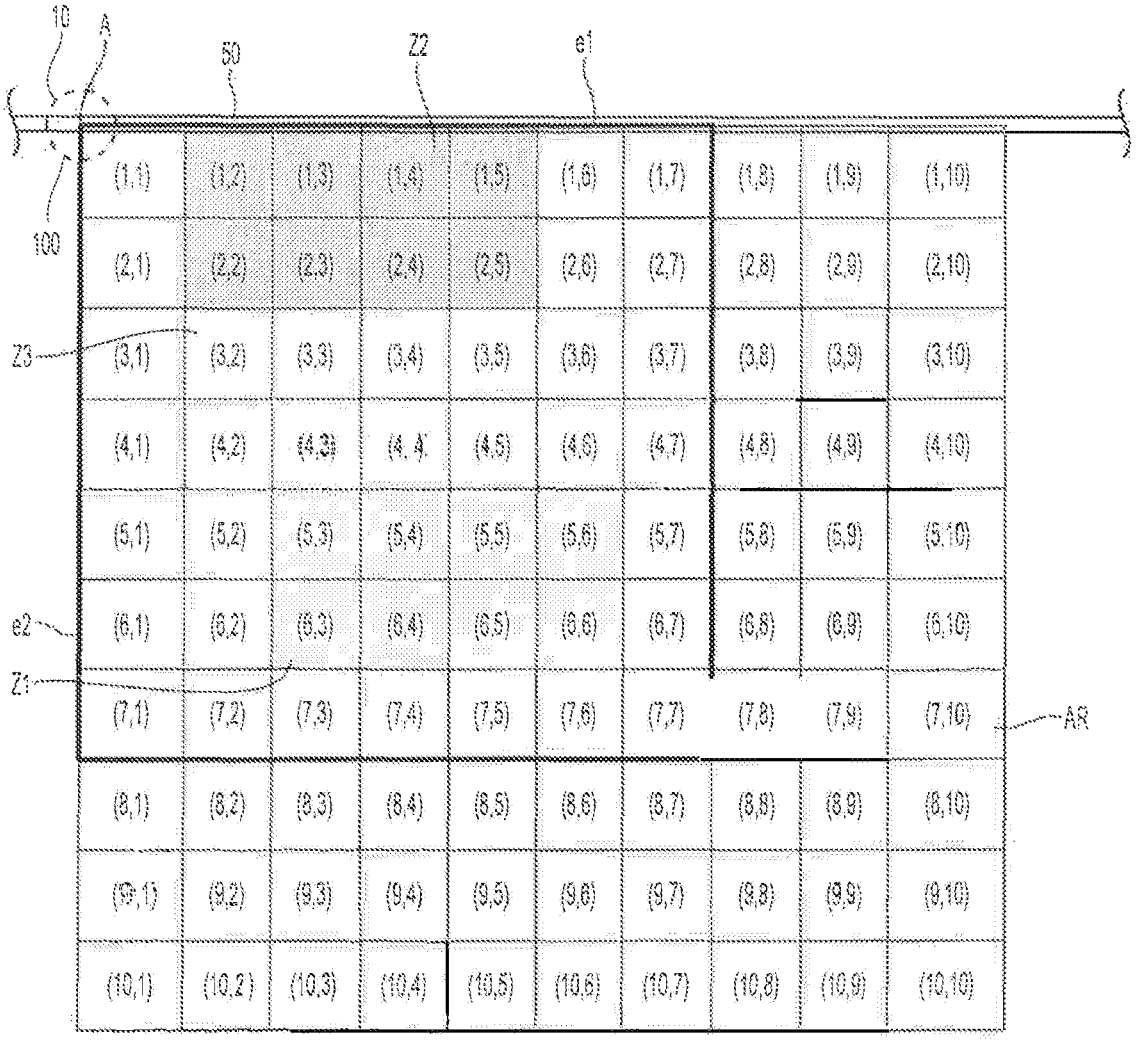
FIG. 2 is a schematic view of an example fluid distribution of a sprinkler.

Examples of the sprinkler 10 have been subjected to fluid distribution testing in which water is discharged from the open (unsealed) sprinkler 10 located a specified distance above a gridded array of one hundred collection buckets each of one cubic foot in volume. The fluid distribution tests enable providing and qualifying a sprinkler for low clearance fire protection. The fluid was discharged from the sprinkler 10 at a fixed flow rate and collected in the collection buckets for a fixed duration of test time tt and the fluid density (flow per area—gpm/sq. ft.). FIG. 2 depicts one quadrant of an area AR of the spray pattern below the sprinkler 10 at a fixed distance. The gridded area AR is a 10 ft.×10 ft. area divided into one hundred one square foot areas. The gridded quadrant has a first edge e1 and a second edge e2 perpendicular to the first edge e1. The intersection of the first and second edges e1, e2 is disposed along the sprinkler axis A-A. The sprinkler 10 is coupled to a fluid supply pipe 50 and the first edge e1 is aligned below and parallel to the fluid supply pipe 50. Each square foot of the gridded area AR is identified by (row, column) relative to the sprinkler axis A-A. The fluid distribution density was determined at two heights below the sprinkler: 2.5 ft. and 12.5 ft.

In one fluid distribution test, the fluid density distribution was determined at an axial distance of two and a half feet (2.5 ft.) below the peripheral edge of the sprinkler deflector 100 and water was supplied to the sprinkler at a pressure of at least 10 psi. to generate a flow rate from the sprinkler of about 60 gallons per minute GPM. The fluid was supplied by a fluid supply pipe 50 having a diameter of two-one half inch (2½ inch). A second fluid distribution test was conducted twelve and one-half feet (12.5 ft.) below the peripheral edge of the sprinkler. Results of the two fluid distribution tests are respectively summarized in Table 1 and Table 2 below:

TABLE 1

| Fluid Distribution (gpm/sq. ft.) at 2.5 ft. | | | | | | | | | | |
|---|---|---|---|---|---|---|---|---|---|---|
| | COLUMN | | | | | | | | | |
| ROW | 1 | 2 | 3 | 4 | 5 | 6 | 7 | 8 | 9 | 10 |
| 1 | 1.000 | 1.667 | 0.267 | 0.133 | 0.067 | 0.033 | 0.000 | 0.000 | 0.000 | 0.000 |
| 2 | 1.800 | 1.267 | 1.000 | 0.733 | 0.267 | 0.067 | 0.033 | 0.000 | 0.000 | 0.000 |
| 3 | 1.200 | 1.067 | 0.800 | 0.400 | 0.133 | 0.033 | 0.000 | 0.000 | 0.000 | 0.000 |
| 4 | 0.667 | 0.667 | 0.467 | 0.267 | 0.033 | 0.033 | 0.000 | 0.000 | 0.000 | 0.000 |
| 5 | 0.400 | 0.400 | 0.267 | 0.067 | 0.033 | 0.033 | 0.000 | 0.000 | 0.000 | 0.000 |
| 6 | 0.133 | 0.133 | 0.067 | 0.033 | 0.033 | 0.000 | 0.000 | 0.000 | 0.000 | 0.000 |
| 7 | 0.000 | 0.000 | 0.000 | 0.000 | 0.000 | 0.000 | 0.000 | 0.000 | 0.000 | 0.000 |
| 8 | 0.000 | 0.000 | 0.000 | 0.000 | 0.000 | 0.000 | 0.000 | 0.000 | 0.000 | 0.000 |
| 9 | 0.000 | 0.000 | 0.000 | 0.000 | 0.000 | 0.000 | 0.000 | 0.000 | 0.000 | 0.000 |
| 10 | 0.000 | 0.000 | 0.000 | 0.000 | 0.000 | 0.000 | 0.000 | 0.000 | 0.000 | 0.000 |

TABLE 2

| Fluid Distribution (gpm/sq. ft.) at 12.5 ft. | | | | | | | | | | |
|---|---|---|---|---|---|---|---|---|---|---|
| | COLUMN | | | | | | | | | |
| ROW | 1 | 2 | 3 | 4 | 5 | 6 | 7 | 8 | 9 | 10 |
| 1 | 0.520 | 0.840 | 0.080 | 0.080 | 0.060 | 0.040 | 0.020 | 0.020 | 0.020 | 0.020 |
| 2 | 0.040 | 0.040 | 0.080 | 0.120 | 0.120 | 0.080 | 0.050 | 0.040 | 0.020 | 0.020 |
| 3 | 0.040 | 0.040 | 0.080 | 0.200 | 0.160 | 0.200 | 0.160 | 0.120 | 0.080 | 0.060 |
| 4 | 0.060 | 0.080 | 0.160 | 0.360 | 0.240 | 0.200 | 0.200 | 0.160 | 0.080 | 0.060 |
| 5 | 0.120 | 0.160 | 0.280 | 0.520 | 0.240 | 0.160 | 0.120 | 0.120 | 0.120 | 0.080 |
| 6 | 0.200 | 0.280 | 0.320 | 0.320 | 0.200 | 0.160 | 0.120 | 0.080 | 0.080 | 0.080 |
| 7 | 0.200 | 0.160 | 0.200 | 0.160 | 0.160 | 0.120 | 0.120 | 0.080 | 0.040 | 0.020 |
| 8 | 0.120 | 0.120 | 0.160 | 0.160 | 0.160 | 0.120 | 0.080 | 0.080 | 0.040 | 0.020 |
| 9 | 0.120 | 0.120 | 0.120 | 0.120 | 0.120 | 0.120 | 0.080 | 0.060 | 0.040 | 0.020 |
| 10 | 0.120 | 0.080 | 0.120 | 0.120 | 0.080 | 0.080 | 0.080 | 0.040 | 0.040 | 0.020 |

The fluid distribution at two and one-half feet (2.5 ft.) below the deflector shows the fluid distribution performance of the sprinkler at low clearance. More specifically, by evaluating the sprinkler fluid distribution within three feet of the sprinkler, the ability of the sprinkler to radially distribute the fluid over the top of a stored commodity can be characterized. With reference to Table 1, the sprinkler 10 generated a total fluid density of at least 15 gpm/sq. ft. within the 10 ft.×10 ft. quadrant of the spray pattern at the height. Moreover, the total fluid density is confined to the 7 ft.×7 ft. area of the quadrant outlined in bold in FIG. 2. Accordingly, given the discharge characteristic of the sprinkler 10 and the symmetry of the pattern and the deflector 100, a total fluid flow of 60 gpm is generated by the sprinkler 10 within 20 ft.×20 ft. area centered about the sprinkler axis A-A two and one-half feet below the sprinkler.

The fluid distribution has other areas or zones of fluid density that characterize the low clearance performance of the sprinkler, for example, with reference to Table 1 and FIG. 2, the spray pattern includes a first zone Z1 within the quadrant AR of fluid distribution spaced four feet from the first edge e1 and within six feet of the first edge e1. Additionally, the first zone Z1 is spaced two feet from the second edge e2 and within six feet of the second edge e2. The fluid density in the first zone Z1 is at least 3% of the total fluid density. With the total fluid density contained within seven feet of each of the first and second edges e1, e2, the fluid density of the first zone Z1 shows that the sprinkler 10 provides sufficient radial throw of firefighting fluid in a region of low clearance, e.g., within three feet below the sprinkler. Notably, no more than two square foot areas in the first zone Z1 have a. fluid density of less than 0.1 gpm/sq. ft., such as no more than one square foot area has a fluid density of less than 0.1 gpm/sq. ft., or zero wetting. Additionally, the quadrant AR of fluid distribution can include a second zone Z2 within two feet of the first edge e1 and within six feet of the second edge e2 in which the fluid density in the second zone Z2 is at least 30% of the total fluid density. The second zone Z2 can be spaced one foot from the second edge e2 and within five feet of the second edge e2. The fluid density of the second zone Z2 can be sufficient to overcome the shadow of the fluid supply pipe 50 on the fluid distribution below the sprinkler 10. A third zone Z3 in the quadrant AR is provided between the first and second zones Z1, Z2 in which the fluid density of the third zone is at least 20% of the total fluid density. The third zone Z3 can be spaced two feet from the first edge e1 and within four feet of the first edge e1 and spaced two feet from the second edge e2 and within five feet of the second edge e2. Table 3 below summarizes the fluid distribution performance.

TABLE 3

| Summary of Fluid Distribution at 2.5 ft. | | |
|---|---|---|
| Area/Zone | Fluid Distribution (gpm/sq. ft.) | Percentage of Total (%) |
| AR | 15.7 | 100 |
| Z1 | 0.5 | 3 |
| Z2 | 5.4 | 34 |
| Z3 | 3.8 | 24 |

With regard to the second fluid distribution density results in Table 2, the fluid density shows that the sprinkler 10 can provide sufficient fluid coverage or density twelve and one-half feet (12.5 ft) below the sprinkler 10 that can be effective for storage fire protection. The fluid distribution can include generating a total fluid density of at least 12 gpm/sq. ft. within the 10 ft.×10 ft, quadrant of the spray patter at the 12.5 ft. height. Accordingly, given the discharge characteristic of the sprinkler 10 and the symmetry of the pattern and the deflector 100, a total fluid flow of 54 gpm of the total fluid flow of 60 gpm generated by the sprinkler 10 is within a 20 ft.×20 ft. area centered about the sprinkler axis A-A 12.5 feet below the sprinkler.

Moreover, at twelve and one-half feet below the sprinkler, the innovative spray pattern provides a sufficient wetting within defined zones of the spray pattern. For example, in the first zone Z1 within seven feet of the first edge e1 and within the seven feet of the second edge e2, the fluid density is at least 15% of the total fluid density in the second quadrant in the second zone Z2 within two feet of the first edge e1 and within six feet of the second edge e2, the fluid density in the second zone Z2 is at least. 10% of the total fluid density; and in the third zone Z3 between the first and second zone, the fluid density is also at least 20% of the total fluid density. Table 4 below summarizes the fluid distribution performance.

TABLE 4

| Summary of Fluid Distribution at 12.5 ft. | | |
|---|---|---|
| Area/Zone | Fluid Distribution (gpm/sq. ft.) | Percentage of Total (%) |
| AR | 12.8 | 100 |
| Z1 | 2.2 | 17 |
| Z2 | 1.4 | 10 |
| Z3 | 1.3 | 10 |

Figure 3:
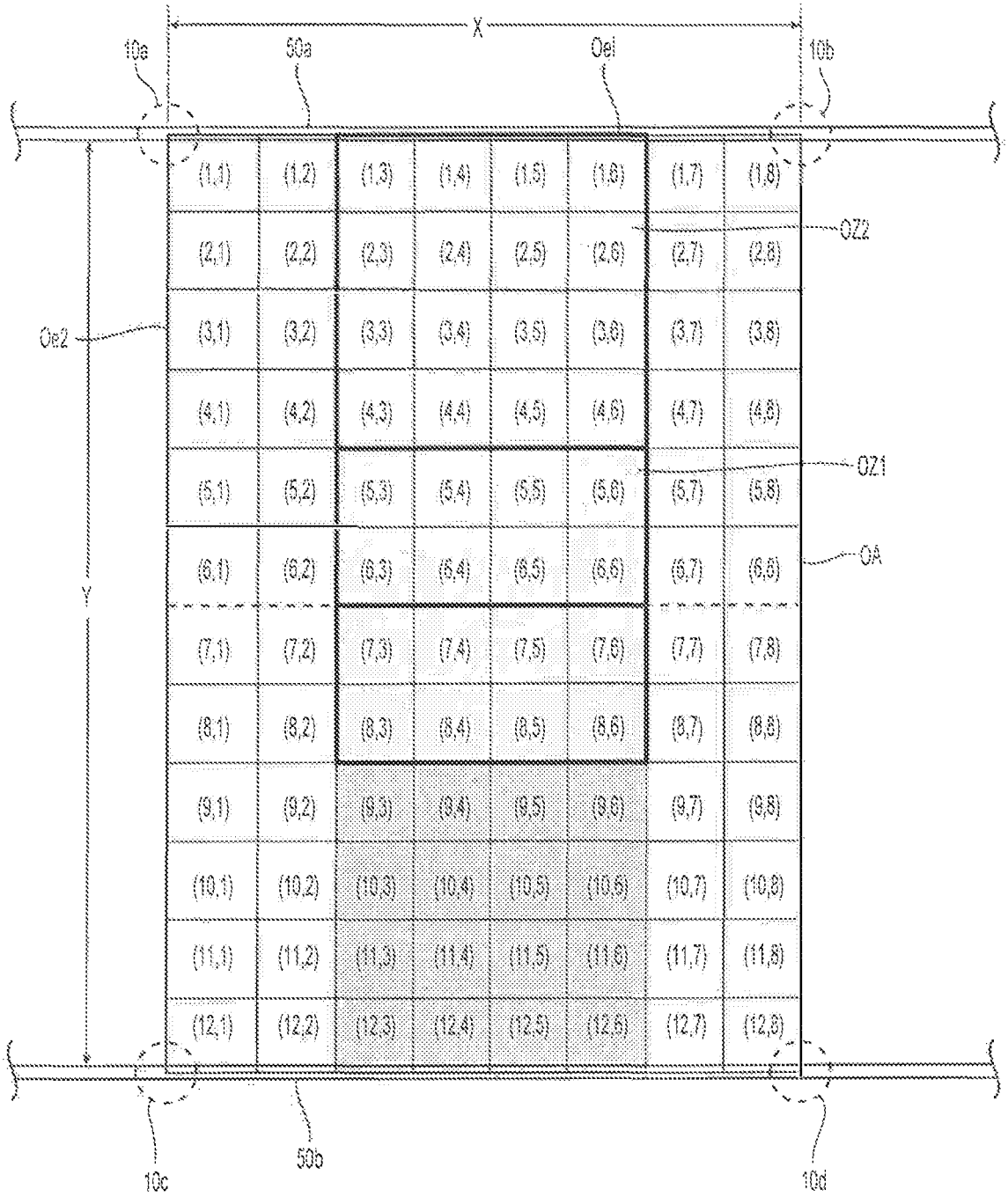
FIG. 3 is a schematic view of an example collective fluid distribution of four sprinklers.

In addition to evaluating the fluid distribution of the sprinkler 10 for low clearance storage protection, the collective performance of multiple sprinklers has been evaluated for its fluid density performance. FIG. 3 depicts an overlapping area OA of the spray patterns below and between the four sprinklers 10*a*, 10*b*, 10*c* and 10*d* at a fixed distance of two and one-half feet (2.5 ft) below the sprinklers. The gridded overlap area OA is a 12 ft.×8 ft. area divided into ninety-six (96) one square foot areas. The four sprinklers 10*a*, 10*b*, 10*c* and 10*d* are coupled to two parallel fluid supply pipes 50*a*, 50*b*, which are spaced apart by twelve feet (12 ft.). A first pair sprinklers 10*a*, 10*b* are coupled to the first fluid supply pipe 50*a* and spaced apart by eight feet (8 ft.) and the second pair of sprinklers 10*c*, 10*d* are spaced apart by eight feet (8 ft.). The overlapping area OA has a first edge oe1 and a second edge oe2 perpendicular to the first edge oe1. The intersection of the first and second edges oe1, oe2 is disposed along the sprinkler axis A-A of the first sprinkler 10*a*. The first edge e1 is aligned below and parallel to the first parallel fluid supply pipe 50*a*.

Given the spacing of the sprinklers, the spray patterns of the sprinkler pair along a common fluid supply overlap one another at the 2.5 ft distance below the sprinklers. Accordingly, to the extent any one sprinkler individually has an area of fluid distribution that is less than 0.1 gpm/sq. ft. at the radial edges of the spray pattern, the overlap in adjacent spray patterns minimizes or eliminates the fluid distribution deficiency. Table 5 below shows the fluid distribution for the four sprinklers 10*a*, 10*b*, 10*c*, and 10*d*.

TABLE 5

| Fluid Distribution at 2.5 ft, and Between Four Sprinklers | | | | | | | | |
|---|---|---|---|---|---|---|---|---|
| | COLUMN | | | | | | | |
| ROW | 1 | 2 | 3 | 4 | 5 | 6 | 7 | 8 |
| 1 | 1.00 | 1.67 | 0.30 | 0.20 | 0.20 | 0.30 | 1.67 | 1.00 |
| 2 | 1.80 | 1.30 | 1.07 | 1.00 | 1.00 | 1.07 | 1.30 | 1.80 |
| 3 | 1.20 | 1.07 | 0.83 | 0.53 | 0.53 | 0.83 | 1.07 | 1.20 |
| 4 | 0.67 | 0.67 | 0.50 | 0.30 | 0.30 | 0.50 | 0.67 | 0.67 |
| 5 | 0.40 | 0.40 | 0.30 | 0.10 | 0.10 | 0.30 | 0.40 | 0.40 |
| 6 | 0.13 | 0.13 | 0.07 | 0.07 | 0.07 | 0.07 | 0.13 | 0.13 |
| 7 | 0.13 | 0.13 | 0.07 | 0.07 | 0.07 | 0.07 | 0.13 | 0.13 |
| 8 | 0.40 | 0.40 | 0.30 | 0.10 | 0.10 | 0.30 | 0.40 | 0.40 |
| 9 | 0.67 | 0.67 | 0.50 | 0.30 | 0.30 | 0.50 | 0.67 | 0.67 |
| 10 | 1.20 | 1.07 | 0.83 | 0.53 | 0.53 | 0.83 | 1.07 | 1.20 |
| 11 | 1.80 | 1.30 | 1.07 | 1.00 | 1.00 | 1.07 | 1.30 | 1.80 |
| 12 | 1.00 | 1.67 | 0.30 | 0.20 | 0.20 | 0.30 | 1.67 | 1.00 |

The sprinklers 10 generated a total fluid density of at least 60 gpm/sq. ft. within the 12 ft.×8 ft. overlap area OA 2.5 ft. below the sprinklers 10*a*, 10*b*, 10*c*, 10*d*. The fluid distribution has other areas or zones of fluid density that characterize the low clearance performance of the sprinkler. For example, with reference to Table 5 and FIG. 3, the spray pattern includes a first overlap zone OZ1 that is centered between the four sprinklers 10*a*, 10*b*, 10*c*, 10*d* and defined by collection areas (5,3) to (5,6); (6,3) to (6,6); (7,3) to (7,6) and (8,3) to (8,6). Additionally, the first overlap zone OZ1 is at least 2% of the total fluid density. Given the overlap, no areas in the first overlap zone OZ1 have a fluid density of less than 0.05 gpm/sq. ft. A second overlap zone OZ2 is defined by the rectilinear area between collection areas from (1,3)-(1,6) to (5,3)-(6,6). The second overlap zone OZ2 shows the fluid distribution contribution by overlapping the spray patterns between two sprinklers 10*a*, 10*b* sharing a common supply pipe 50*a*. The fluid density in the second overlap zone OZ2 is at least 15% of the total fluid density. Table 6 below summarizes the fluid distribution performance between the four sprinklers 10*a*, 10*b*, 10*c*, 10*d*.

TABLE 6

| Summary of Fluid Distribution at 2.5 ft. and Between Four | | |
|---|---|---|
| Area/Zone | Fluid Distribution (gpm/sq. ft.) | Percentage of Total (%) |
| OA | 62.8 | 100 |
| OZ1 | 2.1 | 3.4 |
| OZ2 | 10.5 | 16.8 |

Figure 4A:
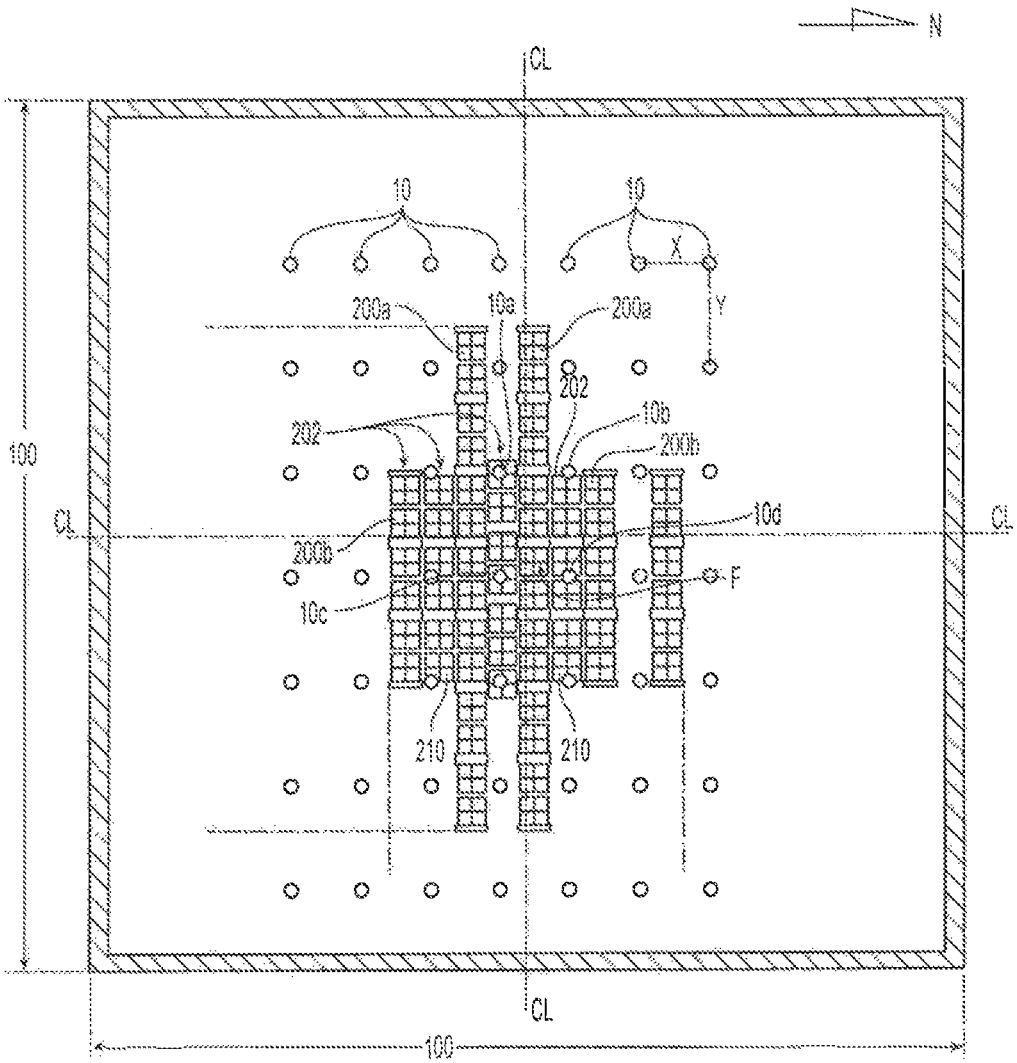
FIG. 4A is a schematic plan view of an example fire test arrangement using a sprinkler.
Figure 4B:
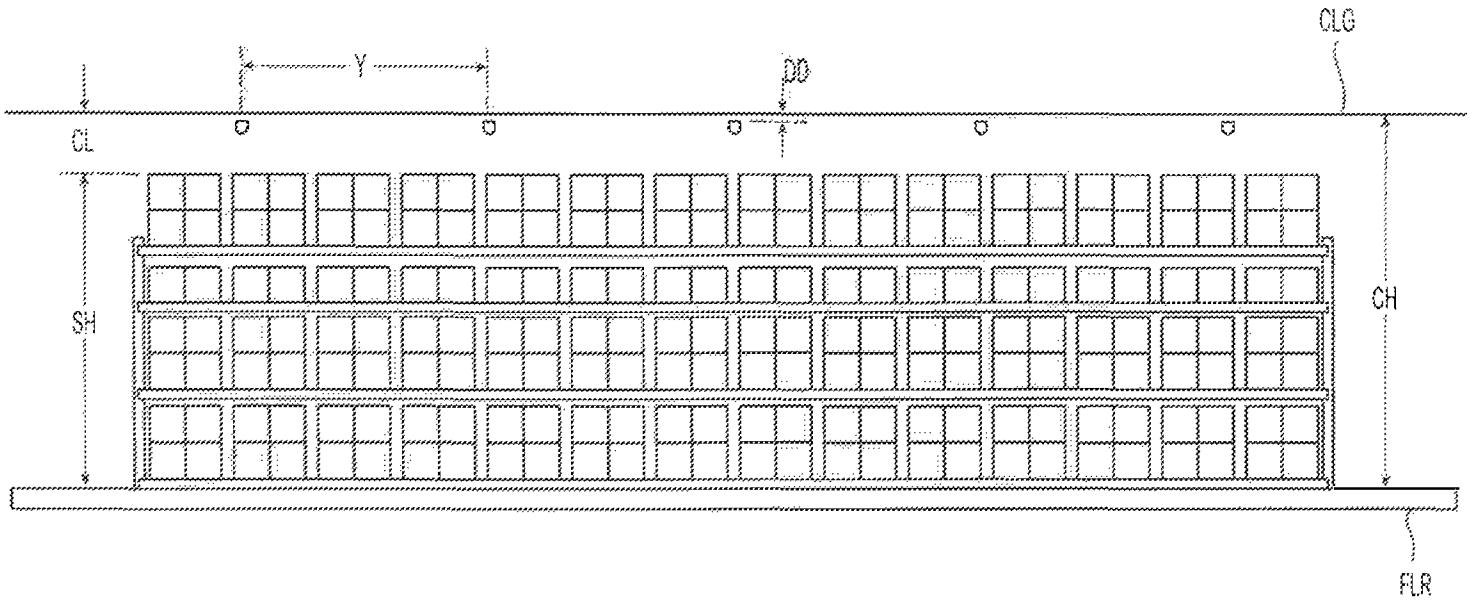
FIGS. 4B and 4C are schematic side and front elevation views of an example fire test arrangement using a sprinkler.
Figure 4C:
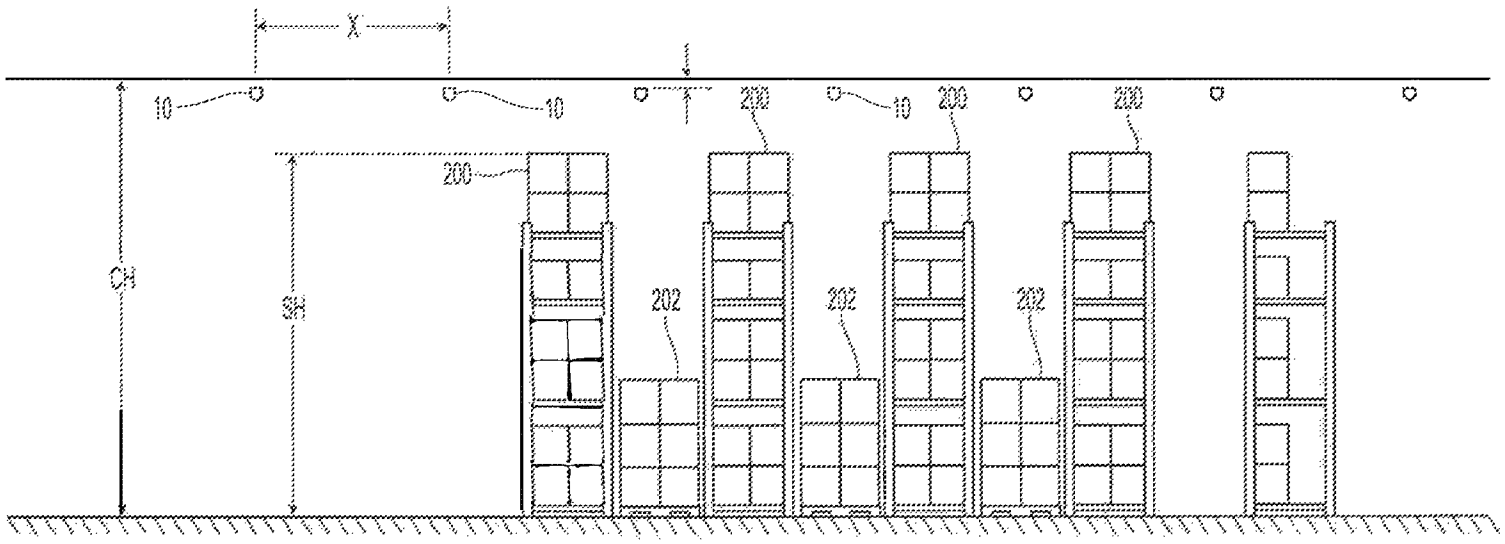

The fluid distribution of the sprinklers individually and collectively can provide an innovative spray pattern that is well suited for low clearance storage fire protection at lower hydraulic demand. To further demonstrate the performance of the sprinkler 10, the sprinkler was fire tested for its ability to effectively address a fire in a stored commodity arrangement FIGS. 4A-4C show the test set up for tire testing. Forty-nine of the upright sprinklers 10 were coupled to a network of fluid supply piping above a floor PLR and beneath a ceiling CLG at a height CH of eighteen feet (18 ft.). The piping included seven branch lines sized at 2.5 inch on 12 ft. spacing. Seven sprinklers were spaced apart on 8 ft. spacing along each branch line. Accordingly, the upright sprinklers were placed on a sprinkler-to-sprinkler spacing (Y×X) by 12 ft.×8 ft. The sprinklers 10 are installed with a deflector-to-ceiling distance DD of six inches (6 in.). An operating pressure ranging from 10-12 psi. was provided to the sprinklers.

Beneath the sprinklers 10 is a test storage arrangement that includes steel racking arrangement in a three-aisle, four-row arrangement. The arrangement included two main arrays 200*a* of seven bays each 56 ft in length with a 4 ft. aisle 202 in between. On each side of the main arrays 200*a* is a target array 200*b* consisting of three bays located across a 4 ft. aisles 202 from the target array 200*a*. The main and target arrays included representative Group A plastic, for example, non-expanded, Cartoned Group A plastic commodity and stacked up to fifteen feet (15 ft.) in height to define a clearance CL between the top of the commodity and the ceiling. In the main array, flue blockers were positioned; and within the three aisles 202 was placed a single level of palletized floor storage which simulates blocked aisles. The test arrangement provides for a set-up that is believed to be more challenging than those used by industry accepted testing or listing agencies. Accordingly, by successful fire testing the sprinklers 10 under such hazard and arrangement conditions, the test can be shown to be suitable for protecting storage occupancies under less harsh conditions or environments.

One of the two main arrays 200*a* was centered between two of the sprinklers and in accordance with the test a fire F was ignited on the floor FIR and offset in the center of the shelf of the centered array 200*a*. In response to the fire, a total of four sprinklers 10*a*, 10*b*, 10*c*, 10*d* were actuated and water discharged from the operated sprinklers 10*a*, 10*b*, 10*c*, 10*d*. After thirty-two minutes (32 min), the fire F was generally contained to the center shelving units in the main array and did not spread across the aisle to the target arrays 200*b*. Accordingly, it is believed that the sprinklers 10 provides a spray pattern effective for ceiling-only (e.g., without in-rack sprinklers) low clearance storage fire protection and in particular for rack storage of plastic and rubber commodities. Moreover, given that the sprinklers effectively addressed the fire in a commodity arrangement that included Group A plastics with storage in the aisles, the spray pattern is suitable for the protection of such hazards and storage arrangements and storage arrangements of lesser hazardous commodities or lesser challenging arrangement.

Based on the test performance, systems and methods of fire protection for storage are provided. The systems and methods include design criteria for ceiling-only fire protection of single, double and multi-row rack storage arrangements. The storage can include plastic commodities including hazards up to cartoned, expanded or nonexpanded, and exposed, nonexpanded Group A plastics. In an arrangement, the storage is arranged beneath a ceiling of no more than twenty that (20 ft.) stored to height defining a clearance CL of less than five feet (5 ft.). The ceiling and commodity height can vary as the present solution can provide effective fluid distribution as described herein for fire protection over a large range of ceiling and storage heights including at heights over twenty feet and with clearances greater than five feet. The systems and methods includes a group or plurality of upright sprinklers 10 for connection to fluid supply piping 50 having a nominal diameter of 2.5 inches at a sprinkler-to-sprinkler spacing (Y×X) of 12 ft.×8 ft. The plurality of sprinklers 10 can include a number of design sprinklers ranging from four to six sprinklers, with each sprinkler having a minimum operating pressure of 10 psi. and/or an operational flow rate of 53 GPM.

The plurality of sprinklers 10 can have a discharge characteristic defined by a nominal K-factor of 16.8 GPM/$(PSI)^{1/2}$. Accordingly, the sprinklers 10 can define a total sprinkler flow rate of 318 GPM at the minimum supply pressure 10 psi to define a density of 0.55 GPM/sq. ft. for the sprinkler-to-sprinkler spacing. Given. the effective firefighting performance of the sprinklers 10 at the provided flow, it is believed that a firefighting system can be designed with total flow rates or demands that are lower for rack storage of plastic commodities even when combined with a hose stream allowance of 250 GPM. In a system having a designed sprinkler flow rate of 318 combined with a hose stream allowance of 250 GPM would provide for a total system flow rate of 568 GPM.

In an example of design criteria for ceiling-only fire protection of single, double and multi-row rack storage arrangements, the plurality of sprinklers 10 include a twelve design sprinklers, e.g., a twelve head design as provided under Ch. 21 of NFPA 13, with each sprinkler having a minimum operating pressure of 10 psi, and/or an operational flow rate of 53 GPM. With the plurality of sprinklers 10 having a nominal K-factor of 16.8 GPM/$(PSI)^{1/2}$, the design sprinklers define a total sprinkler flow rate of 636 GPM to define a density of 0.55 GPM/sq. ft. for the sprinkler-to-sprinkler spacing. Summarized, below in Table 7 are system design criteria:

TABLE 7

Design Criteria for Group A Plastic Rack Storage Up to 15 ft. With a Clearance of Less than 5 ft.

| Design Parameter | System #1 | System #2 |
|---|---|---|
| Sprinkler | Upright | Upright |
| Nominal K-Factor | 1.68 | 16.8 |
| Min Operating Pressure (psi.) | 10 | 10 |
| Min Flow (gpm) | 53 | 53 |
| No. Design Sprinklers | 6 | 12 |
| Sprinkler Spacing (ft. × ft.) | 12 × 8 | 12 × 8 |
| Density Requirement (gpm/sq. ft.) | 0.55 | 0.55 |
| Total Sprinkler Flow (gpm0 | 318 | 636 |
| Hose Stream (gpm) | 250 | 500 |
| Total Flow (gpm) | 568 | 1136 |

Based on the design criteria, a fire protection system for low clearance coverage fire protection of rack storage including Group A plastics can be provided. The system can include a plurality of upright sprinklers for installation at a sprinkler-to-sprinkler spacing of 12 ft.×8 ft above the rack storage. Sprinkler-to-sprinkler spacing can be a minimum 8 ft.×8 ft, to a maximum 12 ft.×12 ft. given the ability of the sprinkler to effectively address the higher hazard storage arrangement in testing. The plurality of sprinklers can include a number of design sprinklers ranging from 6-12 sprinklers at the sprinkler-to-sprinkler spacing to define a distribution density of 0.55 gpm/sq. ft. and a total flow ranging front 300-1200 gpm at a minimum operating pressure of 10 psi.

As previously noted above, the spray pattern described above can provide a fluid flow and distribution effective for low clearance storage fire protection at water demands not previously known before. In an example of fire protection system for a storage occupancy having a floor FLR and a ceiling CLG above the floor FLR, the system includes a plurality of fluid supply pipes disposed beneath the ceiling CLG and a plurality of fluid distribution devices 10 coupled to the fluid supply pipes to define, at least four fluid distribution devices 10*a*, 10*b*, 10*c*, 10*d* in a rectangular arrangement above the floor PLR. Each of the four fluid distribution devices 10*a*, 10*b*, 10*c*, 10*d* generates a spray pattern that overlaps one another to define a rectangular area OA of fluid distribution 2.5 ft. below toe fluid distribution devices 10. The rectangular area OA includes a first pair of edges oe1 extending parallel to the fluid supply pipes and a second pair of edges oe2 extending perpendicular to the first edge oe2. The four fluid distribution devices 10*a*, 10*b*, 10*c*, 10*d* being axially aligned above, a corner of the rectangular area GA. The overlapping rectangular area OA is defined by a grid of one square foot areas totaling an area of no more than 12 ft.×8 ft. The rectangular area OA of fluid distribution has a total fluid density of at least 50 gpm/sq. ft. The rectangular area includes a first zone OZ1 of fluid distribution of a 4 ft.×4 ft. area centered in the rectangular area, the first one having a fluid density that is at least 3% of the total fluid density. The plurality of fluid distribution devices are disposed above a stored commodity in a rack arrangement that includes of Group A unexpanded plastics defining aisles therebetween with pallets disposed in the aisles.

The present solution can include obtaining and providing fluid distribution devices, as previously described, for low clearance storage fire protection. A method includes obtaining a plurality of upright fire protection sprinklers 10 as previously described or fluid distribution devices that in a spaced apart arrangement that are capable of providing a rectangular area OA of fluid distribution 2.5 ft. below the fluid distribution devices as previously described. The process of obtaining and providing the fluid distribution devices can include receiving a sprinkler 10, and/or or the designs and methods of such a system as described above using such a sprinkler 10. In addition, the process of providing a fluid distribution device can include distribution of the sprinkler 10 and/or systems and methods using such a sprinkler 10 as described above.

Having now described some illustrative implementations, it is apparent that the foregoing is illustrative and not limiting, having been presented by way of example. In particular, although many of the examples presented herein involve specific combinations of method acts or system elements, those acts and those elements can be combined in other ways to accomplish the same objectives. Acts, elements and features discussed in connection with one implementation are not intended to be excluded from a similar role in other implementations or implementations.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular can also embrace implementations including a plurality of these elements, and any references in plural to any implementation or element or act herein can also embrace implementations including only a single element. References in the singular or plural form are not intended to limit the presently disclosed systems or methods, their components, acts, or elements to single or plural configurations. References to any act or element being based on any information, act or element can include implementations where the act or element is based at least in part on any information, act, or element.

Any implementation disclosed herein can be combined with any other implementation or embodiment, and references to "an implementation," "some implementations," "one implementation" or the like are not necessarily mutually exclusive and are intended to indicate that a particular feature, structure, or characteristic described in connection with the implementation can be included in at least one implementation or embodiment. Such terms as used herein are not necessarily all referring to the same implementation. Any implementation can be combined with any other implementation, inclusively or exclusively, in any manner consistent with the aspects and implementations disclosed herein.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Systems and methods described herein may be embodied in other specific forms without departing from the characteristics thereof. Further relative parallel, perpendicular, vertical or other positioning or orientation descriptions include variations within +/−10% or +/−10 degrees of pure vertical, parallel or perpendicular positioning. References to "approximately," "about" "substantially" or other terms of degree include variations of +/−10% from the given measurement, unit, or range unless explicitly indicated otherwise. Coupled elements can be electrically, mechanically, or physically coupled with one another directly or with intervening elements. Scope of the systems and methods described herein is thus indicated by the appended claims, rather than the foregoing description, and changes that come within the meaning and range of equivalency of the claims are embraced therein.

The term "coupled" and variations thereof includes the joining of two members directly or indirectly to one another. Such joining may be stationary (e.g., permanent or fixed) or moveable (e.g., removable or releasable). Such joining may be achieved with the two members coupled directly to each other, with the two members coupled with each other using a separate intervening member and any additional intermediate members coupled with one another, or with the two members coupled with each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References to "or" can be construed as inclusive so that any terms described using "or" can indicate any of a single, more than one, and all of the described terms. For example, a reference to "at least one of 'A' and 'B'" can include only 'A', only 'B', as well as both 'A' and 'B'. Such references used in conjunction with "comprising" or other open terminology can include additional items.

Modifications of described elements and acts such as variations in sizes, dimensions, structures, shapes and proportions of the various elements, values of parameters, mounting arrangements, use of materials, colors, orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes and omissions can also be made in the design, operating conditions and arrangement of the disclosed elements and operations without departing from the scope of the present disclosure.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

What we claim is:

1. A fire protection sprinkler having a spray pattern for storage protection, the sprinkler comprising:

a sprinkler frame having a body for coupling to a fluid supply pipe defining an inlet for the receipt of fluid, an outlet with an internal passageway axially extending between the inlet and the outlet along a sprinkler axis disposed perpendicular to the fluid supply pipe; and a deflector coupled to the sprinkler frame, the deflector distributes fluid discharged from the outlet in a spray pattern below the sprinkler, the deflector comprising an arcuate annulus region defined by a constant radius curvature having a center of curvature disposed axially between the inlet and the outlet of the body and which circumscribes the sprinkler axis at a radius ranging from 0.03 to 0.05 inch from the sprinkler axis, the radius of curvature ranging from 1.5 inch to 1.75 inch, a ratio of a second diameter of the passageway to a first diameter of the deflector ranges from 1:1 to 2:1, the spray pattern being centered about the sprinkler axis and defined by a fluid density in a first quadrant area 2.5 feet (ft.) below the sprinkler and perpendicular to the sprinkler axis, the first quadrant area having a first corner disposed along the sprinkler axis with a first edge extending in the direction of the fluid supply pipe, a second edge extending perpendicular to the first edge and intersecting the first edge at the sprinkler axis, the first quadrant area being defined by a grid of one square foot areas totaling an area of no more than 10 ft.×10 ft., the total fluid density being at least 15 gpm/sq. ft., the first quadrant area including a first zone of fluid distribution spaced four feet from the first edge and within six feet of the first edge, the first zone being spaced two feet from the second edge and within the six feet of the second edge, the fluid density in the first zone being at least 3% of the total fluid density.

2. The sprinkler of claim 1, comprising:

the spray pattern is defined by a fluid density in a second quadrant area 12.5 feet below the sprinkler and perpendicular to the sprinkler axis, the second quadrant area having a first corner disposed along the sprinkler axis with a first edge extending in the direction of the fluid supply pipe, a second edge extending perpendicular to the first edge and intersecting the first edge at the sprinkler axis, the second quadrant area being defined by a grid of one square foot areas totaling an area of no more than 10 ft.×10 ft., the total fluid density in the second quadrant being at least 12 gpm/sq. ft., the second quadrant area including a first zone of fluid distribution within seven feet of the first edge and within the seven feet of the second edge, the fluid density in the first zone of the second quadrant being at least 68% of the total fluid density in the second quadrant.

3. The sprinkler of claim 1, comprising:

in the first zone, no more than two square foot areas have a fluid density less than 0.1 gpm/sq. ft.

4. The sprinkler of claim 1, comprising:

the quadrant includes a third zone between the first and second zone, the fluid density in the third zone being at least 20% of the total fluid density.

5. The sprinkler of claim 1, comprising:

the total fluid density is confined within 7 ft. from the first edge and within 7 from the second edge, the quadrant including a second zone within two feet of the first edge and within six feet of the second edge, the fluid density in the second zone being at least 30% of the total fluid density.

6. The sprinkler of claim 1, comprising:

the deflector includes a deflecting surface opposed to the outlet and circumscribed about the sprinkler axis, the internal deflecting surface having a central region, a peripheral region and the arcuate annulus region between the central region and the peripheral region, the central region being a planar surface disposed perpendicular to the sprinkler axis and contiguous with the arcuate annulus region, the arcuate annulus region being contiguous with the peripheral region and the peripheral region including a plurality of spaced apart planar surfaces skewed outwardly with respect to the sprinkler axis to form an outermost peripheral edge of the deflector.

7. The sprinkler of claim 1, comprising:

the sprinkler frame and the deflector define a minimum operating pressure of 10 psi.

8. The sprinkler of claim 1, comprising:

the deflector is disposed about the mount and centered along the sprinkler axis with an internal deflecting surface opposed to the outlet and circumscribed about the sprinkler axis, the internal deflecting surface having a central region and a peripheral region, the arcuate annulus region between the central region and the peripheral region, the central region being a planar surface disposed perpendicular to the sprinkler axis and contiguous with the arcuate annulus region to define the first diameter of the deflector, the arcuate annulus region being contiguous with the peripheral region to define a second diameter of the deflector and the peripheral region including a plurality of spaced apart planar surfaces skewed outwardly with respect to the sprinkler axis to form an outermost discontinuous peripheral edge of the deflector and define a third diameter of the deflector, the peripheral region includes a plurality of tines, each tine having a base contiguous with the arcuate annulus portion and a peripheral edge radially spaced outward from the base to define a tine length therebetween, each tine having a pair of lateral edges spaced apart to define a tine width, the plurality of tines baying a common tine width and a common tine length the plurality of times being equiangularly spaced apart about the sprinkler axis.

9. The sprinkler of claim 1, comprising:

a plurality of tines of the deflector, each tine has a tine width ranging from 0.075 to 0.095 inches and a tine length ranging from 0.1-0.25 inches, and the tines are spaced apart by an angle of fifteen degrees.

10. The sprinkler of claim 1, comprising:

a central region of the deflector is spaced from the outlet of the frame body by a distance of 1.25 inch.

11. The sprinkler of claim 1, comprising:

a ratio of a first diameter of a peripheral edge of the deflector to a second diameter of an arcuate annulus of the deflector inward from the peripheral edge ranges from 1.1:1 to 1.3:1.

12. The sprinkler of claim 1, comprising:

a ratio of a first diameter of a central planar surface of the deflector to a second diameter of a peripheral edge of the deflector ranges from 2:1 to 3.5:1.

13. A deflector of a fire protection sprinkler, comprising:

a deflecting surface coupled to a mount of the sprinkler, the deflecting surface distributes fluid discharged from an outlet of the sprinkler in a spray pattern below the sprinkler, the deflecting surface comprising an arcuate annulus region defined by a constant radius of curvature having a center of curvature disposed axially between an inlet of the sprinkler and the outlet of the sprinkler and which circumscribes the sprinkler axis at a radius ranging from 0.03 to 0.05 inch from the sprinkler axis, the radius of curvature ranging from 1.5 inch to 1.75 inch, a ratio of a second diameter of the passageway to a first diameter of the deflector ranges from 1:1 to 2:1, the spray pattern being centered about a sprinkler axis of the sprinkler and defined by a fluid density in a first quadrant area 2.5 feet (ft.) below the sprinkler and perpendicular to the sprinkler axis, the first quadrant area having a first corner disposed along the sprinkler axis with a first edge extending in the direction of a fluid supply pipe, a second edge extending perpendicular to the first edge and intersecting the first edge at the sprinkler axis, the first quadrant area being defined by a grid of one square foot areas totaling an area of no more than 10 ft.×10 ft., the total fluid density being at least 15 gpm/sq. ft., the first quadrant area including a first zone of fluid distribution spaced four feet from the first edge and within six feet of the first edge, the first zone being spaced two feet from the second edge and within the six feet of the second edge, the fluid density in the first zone being at least 3% of the total fluid density.

14. The deflector of claim 13, comprising:

the spray pattern is defined by a fluid density in a second quadrant area 12.5 feet below the sprinkler and perpendicular to the sprinkler axis, the second quadrant area having a first corner disposed along the sprinkler axis with a first edge extending in the direction of the fluid supply pipe, a second edge extending perpendicular to the first edge and intersecting the first edge at the sprinkler axis, the second quadrant area being defined by a grid of one square foot areas totaling an area of no more than 10 ft.×10 ft., the total fluid density in the second quadrant being at least 12 gpm/sq. ft., the second quadrant area including a first zone of fluid distribution within seven feet of the first edge and within the seven feet of the second edge, the fluid density in the first zone of the second quadrant being at least 68% of the total fluid density in the second quadrant.

15. The deflector of claim 13, comprising:

the deflecting surface is opposed to the outlet and circumscribed about the sprinkler axis.

16. The deflector of claim 13, comprising:

the deflecting surface having a central region, a peripheral region and the arcuate annulus region between the central region and the peripheral region, the central region being a planar surface disposed perpendicular to the sprinkler axis and contiguous with the arcuate annulus region, the arcuate annulus region being contiguous with the peripheral region and the peripheral region including a plurality of spaced apart planar surfaces skewed outwardly with respect to the sprinkler axis to form an outermost peripheral edge of the deflector.

17. The deflector of claim 13, comprising:

the deflecting surface having a central region and a peripheral region, the arcuate annulus region is between the central region and the peripheral region, the central region being a planar surface disposed perpendicular to the sprinkler axis and contiguous with the arcuate annulus region to define the first diameter of the deflector, the arcuate annulus region being contiguous with the peripheral region to define a second diameter of the deflector and the peripheral region including a plurality of spaced apart planar surfaces skewed outwardly with respect to the sprinkler axis to form an outermost discontinuous peripheral edge of the deflector and define a third diameter of the deflector, the peripheral region includes a plurality of tines, each tine having a base contiguous with the arcuate annulus portion and a peripheral edge radially spaced outward from the base to define a tine length therebetween, each tine having a pair of lateral edges spaced apart to define a tine width, the plurality of tines baying a common tine width and a common tine length the plurality of times being equiangularly spaced apart about the sprinkler axis.

18. The deflector of claim 13, comprising:

a plurality of tines, each tine has a tine width ranging from 0.075 to 0.095 inches and a tine length ranging from 0.1-0.25 inches, and the tines are spaced apart by an angle of fifteen degrees.

* * * * *